US006003717A

United States Patent [19]

Long

[11] Patent Number: 6,003,717

[45] Date of Patent: Dec. 21, 1999

[54] COMBINATION OF LOOP-TIE TRASH LINER AND TRASH CONTAINER AND METHOD OF USE

[76] Inventor: Paul Dennis Long, 9000 Aalborg, Fredericiagade, Denmark

[21] Appl. No.: 09/270,508

[22] Filed: Mar. 17, 1999

Related U.S. Application Data

[63] Continuation-in-part of application No. 08/980,776, Dec. 1, 1997, abandoned, which is a continuation-in-part of application No. 08/589,232, Jan. 22, 1996, abandoned.

[51] Int. Cl.[6] ..... B65F 1/06

[52] U.S. Cl. ..... 220/495.11; 383/33; 383/75

[58] Field of Search ..... 383/33, 75; 220/495.08, 220/495.11

[56] References Cited

U.S. PATENT DOCUMENTS

| | | | |
|---|---|---|---|
| 1,941,871 | 1/1934 | Struve | 220/495.11 X |
| 2,092,969 | 9/1937 | Gustafson et al. | 220/495.11 X |
| 2,159,192 | 5/1939 | Werdin | 220/495.11 X |
| 3,135,458 | 6/1964 | Steuart | 383/75 |
| 4,509,570 | 4/1985 | Eby et al. | 383/33 X |
| 4,786,189 | 11/1988 | Broderick et al. | 383/75 |
| 4,938,607 | 7/1990 | Kelly | 383/75 X |
| 4,989,994 | 2/1991 | Gelbard | 383/33 X |
| 5,133,607 | 7/1992 | Bonke | 383/75 |
| 5,213,141 | 5/1993 | Dorman | 383/75 X |

*Primary Examiner*—Jes F. Pascua
*Attorney, Agent, or Firm*—Stephen Christopher Swift

[57] ABSTRACT

A trash liner in combination with a trash container, and a method of using them to dispose of waste material. The trash liner is a bag having an opening and a body without perforations, with the opening of the bag having an edge within which is a tubular channel, and a flexible tying member passing through the tubular channel. Opposite ends of the tying member extend from openings in the tubular channel. The trash liner may be fastened on a trash container by inserting the body of the bag into the trash container, placing the edge of the opening of the bag over the rim of the trash container, and tying the opposite ends of the tying member together. Trash placed within the trash container may be safely removed by untying the ends of the tying member, removing the edge of the opening of the bag from the rim of the trash container, closing the opening of the bag, and again tying the ends of the tying member to secure closure of the bag. In the preferred embodiment, there is a notch in the edge of the opening of the bag, between two openings of the tubular channel, whereby air may be vented when the bag is placed inside the trash container.

20 Claims, 3 Drawing Sheets

COMBINATION OF LOOP-TIE TRASH LINER AND TRASH CONTAINER AND METHOD OF USE

CROSS REFERENCE TO RELATED APPLICATION

This application is a continuation-in-part of Utility patent application Ser. No. 08/980,776, filed Dec. 1, 1997, now abandoned, which is a continuation-in-part of Utility patent application Ser. No. 08/589,232, filed Jan. 22, 1996, now abandoned.

BACKGROUND OF THE INVENTION

1. Field of the Invention

The present invention relates to a trash liner which is used in a trash container, the trash liner having tie strips which are used both to secure the top of the liner to the top of the trash container, and to tightly close the liner when it is full and ready to be removed from the container.

2. Description of the Prior Art

Plastic bags have been used for decades to dispose of trash in a sanitary manner, and to prevent trash containers from becoming soiled and contaminated by trash. They are used in a variety of applications, and come in different sizes and colors. There are specialized bags for carrying, covering, and containing all sorts of waste. Some may be tightly closed, but few can be secured to containers without premature collapsing. The present invention is the combination of a trash container with a bag, preferably made of plastic, for lining the trash container, having a single tie strip, also preferably made of plastic, passing through a single tubular channel at the top of the bag. The tie strip is used both to secure the top of the bag to the top of a trash container, and to tightly close the bag when it is full and ready to be removed from the trash container.

U.S. Pat. No. 1,941,871, issued on Jan. 2, 1934, to Oscar I. Struve, discloses a liner for waste containers, having a plurality of flaps passing over the edge of the opening of a waste container, with rings at ends of the flaps, through which a drawstring is inserted. The flaps may be drawn together to close the liner by lifting the drawstring, when the liner is full and ready to be removed from the waste container. The liner of the instant invention is distinguishable, in that it can be retained on a waste container without the use of flaps, and its tie strip passes through a single tubular channel rather than through a plurality of rings.

U.S. Pat. No. 2,092,969, issued on Sep. 14, 1937, to Arthur Gustafson, Edward Johnson, and Thor Ahlin, discloses a garbage can liner, similar to a rectangular paper bag, having a plurality of apertures around its open end for venting air from the garbage can when the liner is inserted. The liner of the instant invention is distinguishable, in that it has a single tubular channel, rather than a plurality of apertures, and a tie strip passing through the channel.

U.S. Pat. No. 2,159,192, issued on May 23, 1939, to Ernest Russell Werdin, discloses a garbage can liner, with a neck band having longitudinal notches and holes through with a cord is threaded. The liner of the instant invention is distinguishable, in that it has a single tubular channel rather than a plurality of holes, and it does not require a neck band with a plurality of notches.

U.S. Pat. No. 3,135,458, issued on Jun. 2, 1964, to Herbert H. Steuart, discloses a waste collecting bag for plumbers, having an opening, with a seam on only one portion of the opening. A cord is inserted through the seam to tie the bag to a pipe, so that a clean-out rod can be inserted through the other portion of the bag's opening that remains open. The instant invention is distinguishable, in that in it the liner is used in combination with a trash container in which it is placed.

U.S. Pat. No. 4,509,570, issued on Apr. 9, 1985, to Jeffrey Eby and George Spector, discloses an elastic top trash bag, which a hem going all the way around its opening, and an elastic band inside the hem. The liner of the instant invention is distinguishable, in that its tubular channel has opposite openings, and its tie strip has opposite ends that may be tied together.

U.S. Pat. No. 4,786,189, issued on Nov. 22, 1988, to Kevin Broderick et al., discloses a draw tape bag, with two separate tubular channels around its opening, and two separate draw tapes, each of which goes all the way around the opening and passes through both channels. There are gaps between the channels on opposite sides of the bag, and in each gap one of the draw tapes has both of its opposite ends. The liner of the instant invention is distinguishable, in that it has only one tubular channel and only one tie strip. This simpler and more economical arrangement makes it easier to secure the trash liner around the rim of the trash container.

U.S. Pat. No. 4,938,607, issued on Jul. 3, 1990, to Patrick W. Kelley, discloses a sack-forming sheet, with a plurality of peripheral hems through which a draw tape passes. The draw tape is a continuous loop. The liner of the instant invention is distinguishable, in that it has only one tubular channel and it has a tie strip with opposite ends that can be tied together.

U.S. Pat. No. 4,989,994, issued on Feb. 5, 1991, to Edward S. Gelbard, discloses nested plastic bags, in which a drawstring may be threaded through a plurality of holes around the bags' openings to retain the bags on the rim of a trash container. The liner of the instant invention is distinguishable, in that it has a single tubular channel for its tie strip, rather than a plurality of holes.

U.S. Pat. No. 5,133,607, issued on Jul. 28, 1992, to Douglas D. Bonke, discloses a plastic liner bag with an elastic top tie strip, with two separate hems on opposite sides of the bag's opening. The elastic tie strip is a continuous loop. The liner of the instant invention is distinguishable, in that it has a single tubular channel, its tie strip has opposite ends that can be tied together, and its tie strip need not be elastic. The instant invention is also distinguishable, in that in it the rim of the trash container is not completely covered by the liner, because there is a notch in the edge of the liner, through which air can be vented.

U.S. Pat. No. 5,213,141, issued on May 25, 1993, to Ira S. Dorman, discloses a debris collection and disposal system, including a vented collapsible bag having a tie strip threaded through a sleeve around the bag's mouth. The bag is vented by an array of small holes that perforate its body. The liner of the instant invention is distinguishable, in that it is not perforated by an array of holes, and thus will be able to retain small particles and fluids. In the preferred embodiment of the instant invention, air is vented through an U-shaped opening, that is not disclosed in Dorman. Also, in the preferred embodiment, there are two openings in the tubular channel, but Dorman discloses only one opening in the sleeve.

None of the above inventions and patents, taken either singly or in combination, is seen to describe the instant invention as claimed.

SUMMARY OF THE INVENTION

The present invention is a trash liner in combination with a trash container, and a method of waste collection and disposal using them. The trash liner is a bag having an opening and a body without perforations, with the opening of the bag having an edge within which is a tubular channel, and a flexible tying member passing through the tubular channel. Opposite ends of the tying member extend from openings in the tubular channel. The trash liner may be fastened on the trash container by inserting the body of the bag into the trash container, placing the edge of the opening of the bag over the rim of the trash container, and tying the opposite ends of the tying member together. Trash placed within the trash container may be safely removed by untying the ends of the tying member, removing the edge of the opening of the bag from the rim of the trash container, closing the opening of the bag, and again tying the ends of the tying member to secure closure of the bag. In the preferred embodiment, there is a notch in the edge of the opening of the bag, between two openings of the tubular channel, whereby air may be vented when the bag is placed inside a trash container.

Accordingly, it is a principal object of the invention to provide an improved trash liner that can be securely fastened to a trash container.

It is another object of the invention to provide an improved trash liner than can be used to secure and remove the contents of a trash container.

It is a further object of the invention to provide a bag with a tie strip that can be used in combination with a trash container.

Still another object of the invention is to provide a method of waste collection and disposal.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a combination of a trash liner and a trash container, and a method of waste disposal using them. The trash container is preferably cylindrical or frustoconical, with a hollow interior and a circular top opening with a rim. The trash liner has tie strips which are used both to secure the top of the trash liner to the top of the container, and to tightly close the trash liner when it is full and ready to be removed from the container.

Figure 1:
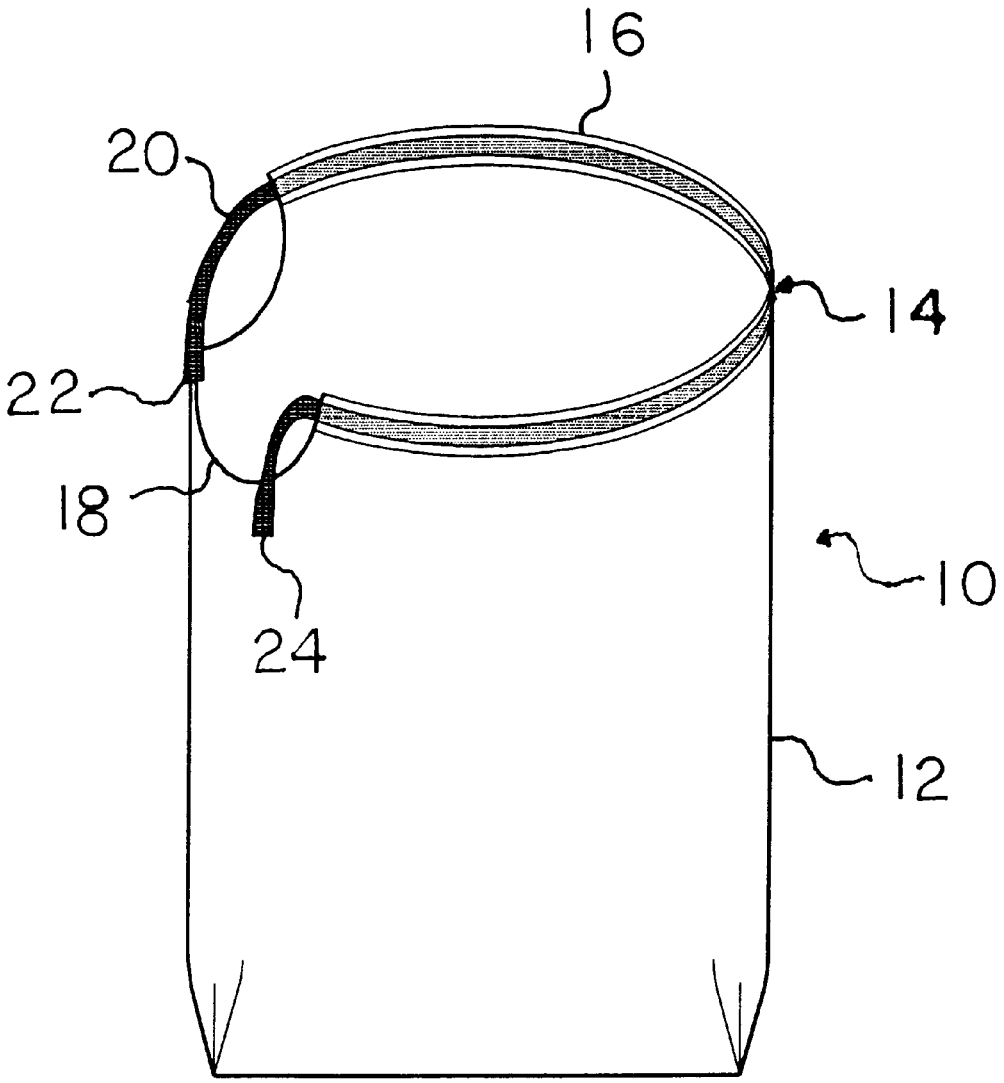
FIG. 1 is a right side perspective view of the trash liner of the invention.

FIG. 1 is a right side perspective view of the preferred embodiment of the trash liner 10, showing the main body of the bag 12 and the opening of the bag 14. Along the greater part of the edge of the opening of the bag is a tubular channel 16. On one side of the opening there is an U-shaped notch 18. A tie strip 20 is inserted within the tubular channel. Opposite ends 22 and 24 of the tie strip extend from openings in the tubular channel at opposite sides of the U-shaped notch.

Figure 2:
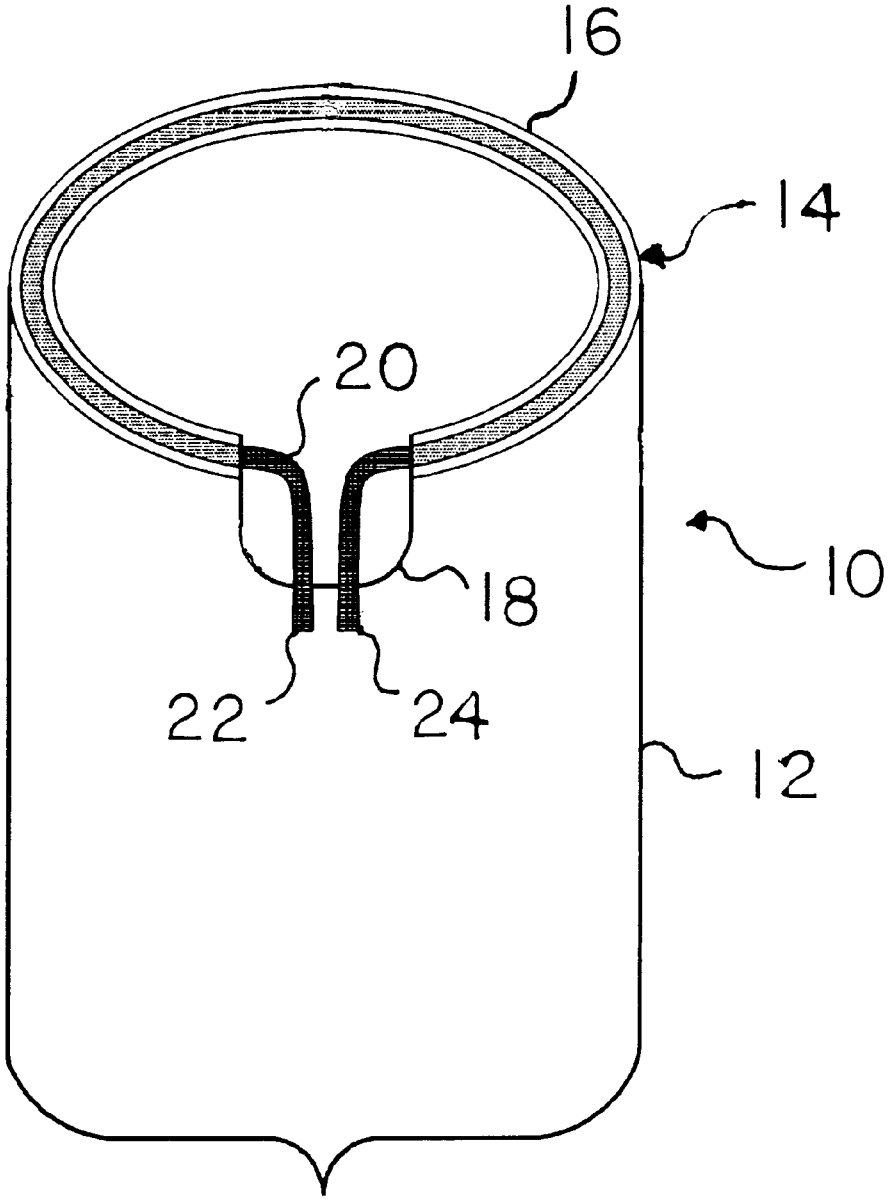
FIG. 2 is a front perspective view of the trash liner of the invention.

FIG. 2 is a front perspective view of the preferred embodiment of the trash liner 10. The width of the notch 18, between the two openings of the tubular channel 16, is preferably no greater than five, ten or twenty percent of the length of the edge of the opening 14 of the bag 12.

Figure 3:
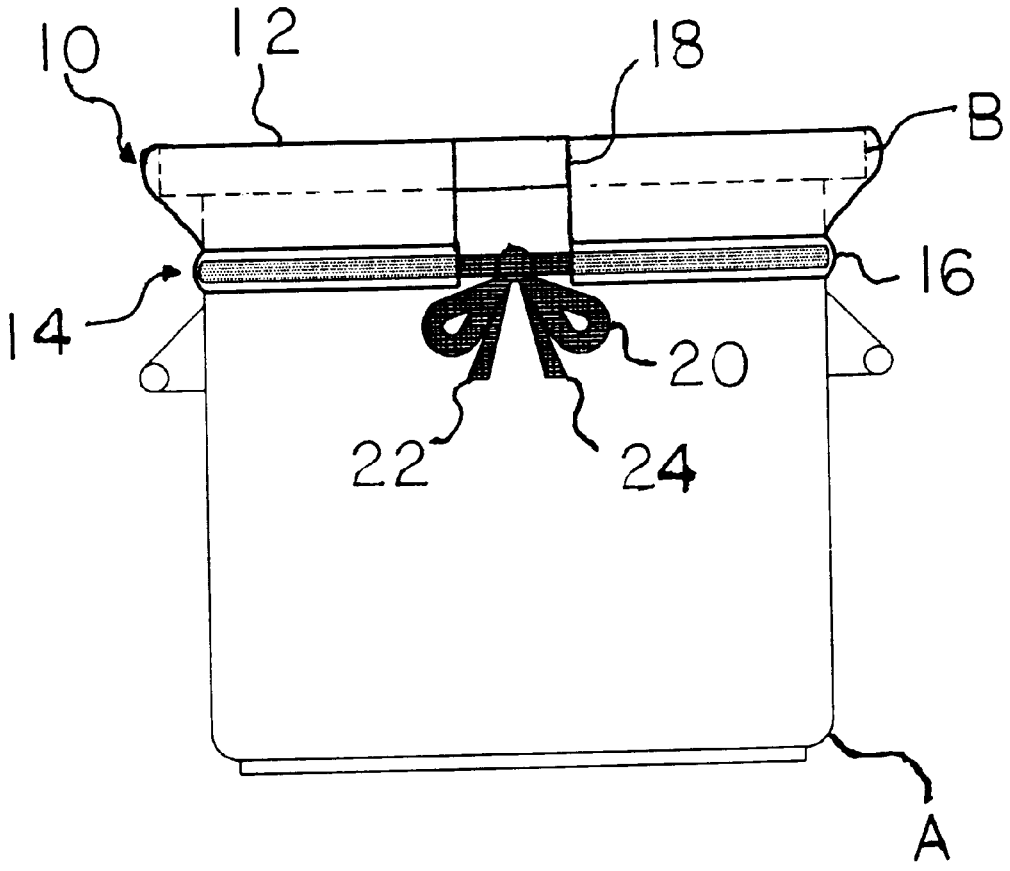
FIG. 3 is a front elevational view of the invention.

FIG. 3 is an front elevational view of the invention, showing the trash liner attached to the trash container A having a top opening with rim B. The edge of the opening 14 of the bag is placed outside the trash container's rim, while most of the bag's main body 12 is inside the container. When the liner is placed on the container, air inside the container is vented through the notch 18, so that the main body can lie flat against the interior surface of the container, and the container can be filled to its maximum capacity. (The portion of the liner that is inside the container is not shown in FIG. 3.) Opposite ends 22 and 24 of the tie band 20 are tied together to securely retain the liner on the container. When the container has been filled with trash or other contents, the contents can be securely removed from the container, by untying the ends of the tie strip, removing the edge of the opening of the bag from the rim of the trash container, closing the opening of the bag, and again tying the ends of the tying member to secure closure of the bag. The ends of the tie strip may then be used to lift the bag out of the container.

The bag should be made of a flexible material and should not have perforations, so that small particles may be retained within the bag. It is preferable that the material be impervious to water or other liquids that may be placed within the bag.

A cord or other flexible tying member may be substituted for the tie strip. The flexible tying member should be made of heavy gauge plastic or other material strong enough to support the weight of the bag. The tying member must be longer than the tubular channel, so that its ends will extend outside the channel's openings.

In the preferred embodiment both the bag and the tie strip are made of plastic. The plastic may be formed from polyethylene, vinyl-acetate copolymers, or other suitable polymers. The tie strip may be elastic, but it is preferable that it not be elastic, so that it will be easier to carry a filled bag by grasping the ends of the tie strip. The tubular channel may be formed by bending over the edge of the bag against its outside surface, and attaching the edge and outside surface by heat sealing or other suitable means.

Although primarily intended as a means and method of disposing of refuse, the invention may also be used for other purposes. It is to be understood that the present invention is not limited to the sole embodiment described above, but encompasses any and all embodiments within the scope of the following claims.

I claim:

1. A trash liner in combination with a trash container, comprising:

a trash container having a hollow interior and an opening with a rim;

a bag having an opening and a body without perforations, and the opening of the bag having an edge;

a single tubular channel within the edge, with the tubular channel having two openings;

a single flexible tying member passing through the tubular channel, the tying member having two opposite ends passing through the two openings; and a notch in the edge of the opening of the bag, between the two openings of the tubular channel, suitably dimensioned and configured so that air may be vented when the body of the bag is placed in the hollow interior of the trash container, but when the edge of the opening of the bag over is placed over the rim of the opening of trash container, and the opposite ends of the tying member are tied together, the rim is completely covered by the bag, except for an area of the rim where the notch is placed;

whereby trash placed within the trash container may be safely removed by untying the ends of the tying member, removing the edge of the opening of the bag from the rim of the trash container, closing the opening of the bag, and again tying the ends of the tying member to secure closure of the bag.

2. The trash liner in combination with a trash container according to claim 1, wherein the width of the notch, between the two openings of the tubular channel, is no greater than twenty percent of the length of the edge of the opening of the bag.

3. The trash liner in combination with a trash container according to claim 1, wherein the width of the notch, between the two openings of the tubular channel, is no greater than ten percent of the length of the edge of the opening of the bag.

4. The trash liner in combination with a trash container according to claim 1, wherein the width of the notch, between the two openings of the tubular channel, is no greater than five percent of the length of the edge of the opening of the bag.

5. The trash liner in combination with a trash container according to claim 1, wherein the bag is made of a flexible, waterproof material.

6. The trash liner in combination with a trash container according to claim 1, wherein the bag is made of plastic.

7. The trash liner in combination with a trash container according to claim 1, wherein the flexible tying member is a plastic strip.

8. The trash liner in combination with a trash container according to claim 1, wherein the flexible tying member is elastic.

9. The trash liner in combination with a trash container according to claim 1, wherein the flexible tying member is not elastic.

10. A trash liner in combination with a trash container, consisting of:

a trash container having a hollow interior and an opening with a rim;

a bag having an opening and a body without perforations, and the opening of the bag having an edge;

one and only one tubular channel within the edge, with the tubular channel having two openings;

one and only one flexible tying member passing through the tubular channel, the tying member having two opposite ends passing through the two openings; and a notch in the edge of the opening of the bag, between the two openings of the tubular channel, suitably dimensioned and configured so that air may be vented when the body of the bag is placed in the hollow interior of the trash container, but when the edge of the opening of the bag over is placed over the rim of the opening of trash container, and the opposite ends of the tying member are tied together, the rim is completely covered by the bag, except for an area of the rim where the notch is placed;

whereby trash placed within the trash container may be safely removed by untying the ends of the tying member, removing the edge of the opening of the bag from the rim of the trash container, closing the opening of the bag, and again tying the ends of the tying member to secure closure of the bag.

11. The trash liner in combination with a trash container according to claim 10, wherein the width of the notch, between the two openings of the tubular channel, is no greater than twenty percent of the length of the edge of the opening of the bag.

12. The trash liner in combination with a trash container according to claim 10, wherein the width of the notch, between the two openings of the tubular channel, is no greater than ten percent of the length of the edge of the opening of the bag.

13. The trash liner in combination with a trash container according to claim 10, wherein the width of the notch, between the two openings of the tubular channel, is no greater than five percent of the length of the edge of the opening of the bag.

14. The trash liner in combination with a trash container according to claim 10, wherein the bag is made of a flexible, waterproof material.

15. The trash liner in combination with a trash container according to claim 10, wherein the bag is made of plastic.

16. The trash liner in combination with a trash container according to claim 10, wherein the flexible tying member is a plastic strip.

17. The trash liner in combination with a trash container according to claim 10, wherein the flexible tying member is elastic.

18. The trash liner in combination with a trash container according to claim 10, wherein the flexible tying member is not elastic.

19. A method of disposing of waste material, comprising the steps of:

inserting a trash liner into a trash container, said trash liner having an opening and a body without perforations, the opening of the trash liner having an edge, with a single tubular channel having two openings within the edge, and a single flexible tying member passing through the tubular channel, the tying member having two opposite ends passing through the two openings;

folding the edge over a rim of the trash container;

tying together the opposite ends of the tying member to securely retain the trash liner on the trash container;

placing waste material in the trash container protected by the trash liner; and venting air from any space between the trash liner and the trash container through a notch in the edge of the opening of the trash liner, the notch being between the two openings of the tubular channel, and the notch being suitably dimensioned and configured so that air may be vented when the body of the trash liner is placed inside the trash container, but when the edge of the opening of the trash liner is placed over the rim of the trash container, and the opposite ends of the tying member are tied together, the rim is completely covered by the bag, except for an area of the rim where the notch is placed.

20. A method of disposing of waste material according to claim 19, including the further steps of:

untying the ends of the tying member;

removing the edge of the opening of the bag from the rim of the trash container;

closing the opening of the bag;

retying the ends of the tying member to secure closure of the bag; and disposing of the trash liner and its contents.

* * * * *